United States Patent [19]

Rice

[11] 4,374,538

[45] Feb. 22, 1983

[54] APPARATUS FOR DECORING AND EXPLOSIVE TREATMENT OF MATERIALS

[75] Inventor: Warren A. Rice, Dexter, Mich.

[73] Assignee: Robert Bosch GmbH, Stuttgart, Fed. Rep. of Germany

[21] Appl. No.: 150,606

[22] Filed: May 16, 1980

[51] Int. Cl.[3] ..... B22D 29/00

[52] U.S. Cl. ..... 164/401; 15/406; 134/79; 164/132; 241/1; 241/DIG. 10

[58] Field of Search ..... 264/84; 15/405, 406; 164/48, 132, 181, 183, 224, 401; 241/1, 301, DIG. 10; 134/19, 79, 157

[56] References Cited

U.S. PATENT DOCUMENTS

| | | | |
|---|---|---|---|
| 1,455,975 | 5/1923 | Spencer et al. | 241/1 X |
| 2,317,574 | 4/1943 | Williams | 164/181 |
| 3,030,678 | 4/1962 | Huston et al. | 164/48 |
| 3,547,589 | 12/1970 | Rice et al. | 264/80 X |
| 3,743,692 | 7/1973 | Vinton et al. | 164/132 X |

*Primary Examiner*—Gus T. Hampilos
*Assistant Examiner*—J. Reed Batten, Jr.
*Attorney, Agent, or Firm*—Frishauf, Holtz, Goodman & Woodward

[57] ABSTRACT

An explosion treatment apparatus useful for confined shock exposure of materials as for removal of sand cores from finished castings and, in particular, cores in permanent mold castings in which a horizontally axised index device successively presents plural and substantially similar cavities to a position at which sealing, evacuating, fueling and ignition occur. This results in an explosion which occurs upon closure of each chamber. After the confined explosion, the cavity is opened and all cavities are indexed so that the fired cavity can be unloaded, the previously unloaded cavity can be dumped, the next adjacent cavity can be reloaded, and the reloaded cavity is presented to closure.

1 Claim, 7 Drawing Figures

APPARATUS FOR DECORING AND EXPLOSIVE TREATMENT OF MATERIALS

BACKGROUND OF THE INVENTION

In U.S. Pat. No. 3,175,025, the inventors, Henry C. Geen and Warren A. Rice, expressed a process for the thermal treatment of a porous mass entitled Process for Bonding and/or Reticulation in which a porous or cellular mass was positioned in a sealed chamber. The chamber was evacuated and the chamber was then subjected to low level pressurization by a mix of a combustible gas and a combustion supportive gas, such as oxygen. The gas permeated the porous material and the combustible mix was then ignited as by a spark plug and the resulting transient thermal energy generated a wave thrusting into the porous mass and decomposing thin membranes of thermoplastic material.

The process, as applied to sand cores and to their removal (designated as decoring) from molds and castings, was expressed in the U.S. Pat. No. 3,743,692 to Clarence Samuel Vinton and Warren A. Rice and it was found that the process for removal of cores was applicable to intricate core forms with cast parts with substantial reduction in manual or mechanical effort formerly required to achieve removal. In particular, the process caused selective degradation of binder materials so that the sand, as structured in the core, was easily reduced to a flowable dry granular form and can be easily drained from the casting and without damage to the casting. The ignitable gases permeated the core material through the interconnected voids and upon detonation or ignition and confinement of the resultant shock, the cores were reduced to fine rubble.

The equipment available for practice of the processes, as indicated in the prior art, comprises stationary chambers such as the apparatus described in U.S. Pat. No. 3,547,589 to Edwin E. Rice and Warren A. Rice directed to a shuttle type vessel and devised principally for surface treatment as in polyurethane foam reticulation and the like. Such devices were not amenable to production use with castings and for removal of cores from the castings.

The present device is intended to provide a relatively high speed cyclic structure allowing for loading, firing, venting or opening, dumping and reloading. At the firing station, air evacuation is provided from the closed chamber; a combustible mixture is injected and pressurized; the mix is ignited or fired in the presence of castings requiring decoring; and the gaseous products of combustion are thereafter removed and released from the chamber. Then the chamber is released from and indexed away from the radially moving loading and firing head and the apparatus indexes the fired chamber to an unloading station where the castings are removed with the cores degraded by the shock force of the contained combustion. As this occurs, a loaded, fresh chamber is presented to the firing station and the firing head closes upon the chamber and seals it for the indicated procedures. Upon release from the firing station, all chambers move on the center horizontal axis and the unloaded chamber moves to an inverted position dumping core material or debris, such as sand and fractured binder, such as organic or inorganic adhesive for the core sand and the like. Thus, a uniform dwell time occurs at each station and each station is a work station so that at each firing the chambers which are not beneath the firing head are accommodating unloading, dumping, and finally loading, preliminary to movement beneath the firing head and ultimate firing.

The structure is simple and highly amenable to variations in structural sizes to handle chambers as large or small as the work performed requires. The major journalling is on a single axis. The sealing register is established on a radial line intersecting the principal machine axis of rotation and the machine support bolsters the axis and may be configured to suit any materials handling apparatus which is sought to serve the several work stations. The straight-line sealing movement of firing head to chamber lip is economical of seal elements and efficient in withstanding a wide range of selected operating pressures. In addition, the closure stroke is mechanically simple on relatively simple guides and via hydraulic, pneumatic, or mechanical means amenable to simple locking and simple release, if necessary.

Aside from the closure or igniting position, a plurality of work stations are provided for the chambers as an unloading station, a dumping station for debris in the chambers, and a loading station.

Accordingly, the principal object of the present invention is to provide a new and useful apparatus for the explosion treatment of materials and especially adapted to decoring or casting core removal.

Another object is to provide such a machine or apparatus on a single axis with plural and radially disposed stations, one of the stations including a dwell for treatment of the contents of one of the plural chambers and where the sealing of the chamber is achieved by force through the chamber and into the machine axis and frame.

Still another object is to provide an apparatus which is largely self-cleaning of its abrasive and gritty working environment and which lends itself to safe and leak resistant operation in a confined pressurized explosion mode.

Still another object is to provide for the inversion of the chambers in their cyclic path.

Other objects attending the simplicity of the apparatus will be appreciated, such as apparatus amenability to relatively simple controls and simple movement coordination on indexing.

Those skilled in the art of confined explosion treatment of materials will readily appreciate the economy and improved performance available in the device of the present invention, especially as applied to decoring.

GENERAL DESCRIPTION

In general, the apparatus of the present invention for confined explosion treatment as for decoring is primarily noteworthy for its simplicity. A plurality of driven chambers are supported on an axis established by a frame. The frame also supports a closure which is radially movable to close and open the chambers as they are successively presented beneath the closure. A machine frame in the form of an inverted U is provided. Transversely between the legs of the frame is an axle. The axle is suitably journalled in the legs and by reason of the construction can be suitably massive and sealed to accommodate the stress requirements of the operating environment. Riding on the axle and pivotal therewith is a mouting block or rotor block having radially facing surfaces. Each surface supports a radially extending tube or cylinder closed at the base by attachment to the respective surfaces of the rotor block. The cylinders may be interchangeable and self-contained and attachable to the rotor surfaces or the connection of the cylinders at the surfaces may be made integral as by welding or otherwise to provide a gas tight heavily supported attachment to the rotor surfaces. The length and diameter of the cylinders is such as to allow rotation with clearance beneath the web portion of the frame and between the legs thereof. The cylinders may contain filler materials to eliminate unnecessary voids between the cylinder walls and the castings being decored. A linear actuator such as an hydraulic or pneumatic cylinder is mounted on the upper web so that the axis of movement thereof, when extended, transversely intersects the axis of the axle of the machine. The actuator is attached to the frame and a piston portion extends through the web and is attached to a closure plate movable by the actuator toward and away from the open end of the cylinder and on the axis thereof when each cylinder is in registry with the actuator. The closure plate is thus caused to close and seal on the successively presented rotating cylinders, one at a time, and to achieve a pressure and gas tight seal so as to form a pressure chamber at that position. Alternatively, the closure plate may be immovably fixed and the cylinder assembly can be moved against the closure plate to effect the seal. Various seals are suitable depending upon operating pressures in the chamber and the seals in the closure plate are not an inventive feature under consideration here. The closure plate is penetrated by passages to communicate with the interior of the chamber on closure. Valves provide selective control means for the communication of combustible and combustion supporting material in mixed proportions to the chamber being served. The passages and valves also provide a connecting means to evacuate air from the chamber and cores and to vent the combustion products therefrom at the desired times in the cycle. An ignition means such as a spark plug is also provided in connection with the passages and the spark generating terminals are in communication with the combustible mixture in the chamber. The control valves and the ignition means can be in a fixed position or can move with the closure plate as it moves toward closing the chamber formed by the cylindrical tubes and in opening each chamber after firing such as by being mounted on the closure plate. At the firing station where the closure plate is positioned, the dwell in the machine is established. While the chamber element is closed and sealed, the chamber and core are evacuated, the combustible mix is added under selected pressure to the chamber, filling it and the voids in the core contained within the chamber, and the mix is ignited or fired. The shock and pressure surge in the chamber and core attacks the interstitial binding between sand particles in a decoring operation and the sand cores disintegrate within the parts or molds. The permeability and uniformity or homogeneity of the shock into and throughout usually inaccessible places reduces the bond strength between the sand particles. After firing, the chamber is opened by backing away the closure plate or chamber and the fired chamber rotates around the axis established by the axle on the frame to an unloading station where the parts or castings are removed for "shake out". The dwell at this unloading station is the same as the dwell at the firing station and unloading proceeds while the firing sequence proceeds in the next adjacent trailing chamber. Upon subsequent next indexing and when completely inverted, the chamber dumps its debris and sand at a dumping station. Further indexing of the chambers allows the cylinders forming the chambers to be loaded or filled with untreated castings and the time for achieving loading is the aforementioned dwell period. The loaded chamber is then index-presented in closing registry beneath the closure plate. An index drive structure rotates the cylinders between the legs of the frame and on the axis of the axle. The explosion pressures being confined are borne by the closure plate and cylinder and thence to the web of the frame and from the journal structure back into the frame. A frame pedestal supports the entire machine.

Sequencing controls (forming no part of the present invention) are provided for the closure and for the release of the closure plate in establishing interval of dwell and the served chamber is rotated away from closure registry after opening and the newly loaded chamber is presented. Vacuum, fuel introduction and pressurization of the chamber is followed by firing. Then the chamber is normalized at atmospheric conditions and is opened by backing away the closure element by means of the linear actuator.

The simplicity of the structure is adapted to a wide variety of controls such as electrical and electronic controls over valves, actuator, and index drive. Ultimate actuation at the working site is preferred using hydraulics and hydraulic piloted equipment for safety reasons. Materials handling equipment, not a part of the present invention, are easily adapted to serve the machine and to provide automated unloading, debris removal and loading. Fuel mixtures are easily adjusted to optimum conditions in accord with materials treated and vacuum and pressurization are similarly selected to perform on the selected materials in an optimum way.

IN THE DRAWINGS

SPECIFIC DESCRIPTION

Figure 1:
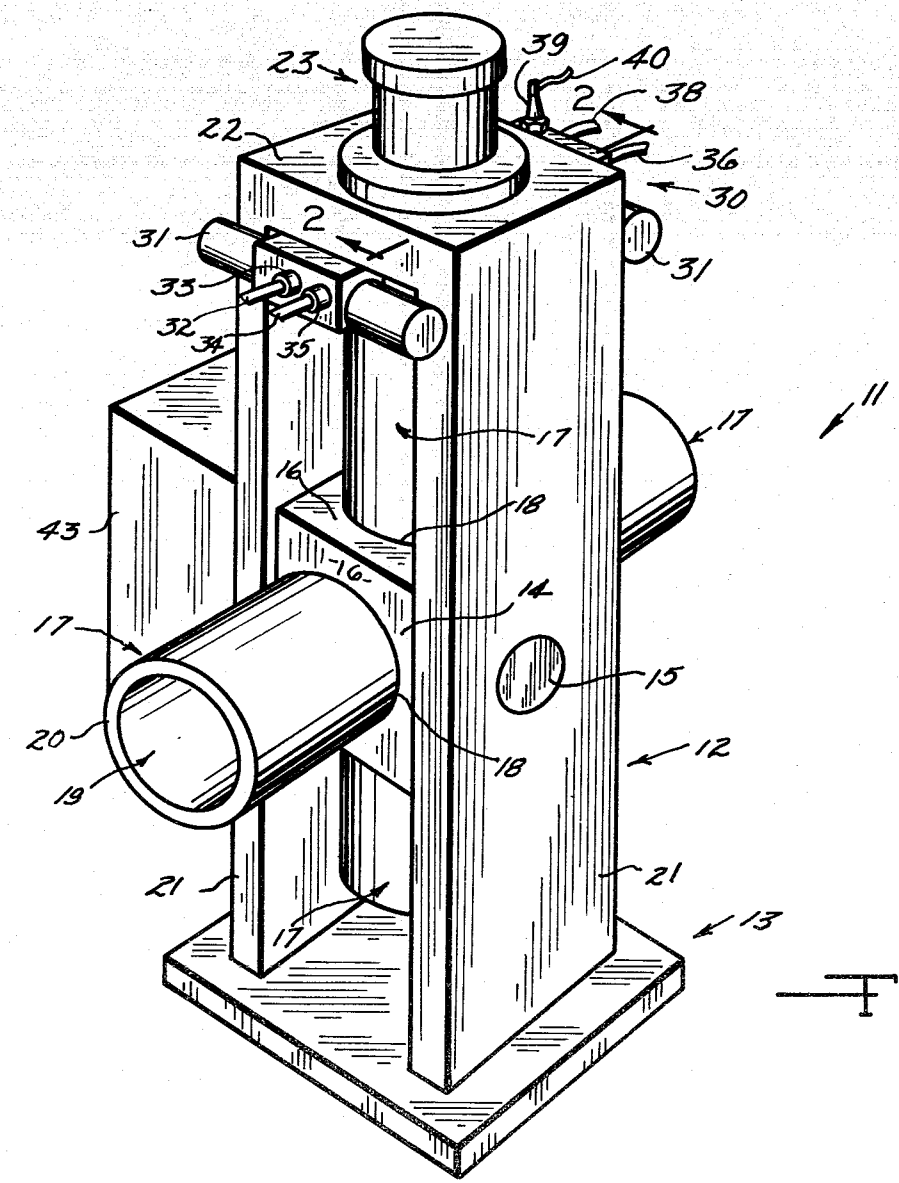
FIG. 1 is a perspective view of the structure of the present invention and illuminates the stark simplicity of the apparatus in avoidance of ways and guides and shuttles.

Referring to the drawings and with first reference to the FIG. 1 thereof, the explosive treatment apparatus 11 of the present invention, without attached electrical, electronic, servo and/or hydraulic controls is shown. The apparatus 11 includes a legged frame 12 mounted on a base or pedestal 13 and the frame 12 rotationally supports a rotor block 14 having an axle 15 so that the axis of the rotor block 14 is substantially horizontal. The rotor block 14 includes a plurality of radially facing surfaces 16. Thus, the block 14 is pivotal on the frame 12 at the axle 15. A tubular cylinder 17 having a gas tight closed end adjacent to surface 16 is connected to each of the surfaces 16 so as to extend radially from the block 14, the radial axes of the cylinders 17 transversely passing through the axis formed by the axle 15. As thus far described, the tubes 17 are attached to the block 14. This forms plural chambers 19, each having an open outer end 20 and the end 20 is thus a sealing annulus in a plane transverse to the axis of the chambers 19.

The frame 12 includes a pair of spaced-apart upstanding legs 21 which rise upward from connection to the base 13 and the legs 21 rotationally support therebetween the rotor element 14 on axle 15. A web portion 22 of the frame 12 is shown as integral between the legs 21 and provides the frame 12 with the overall appearance of an inverted U with the axle 15 and rotor 14 journalled about midway of the ends of the legs 21.

The web 22 supports a linear actuator 23 shown as a double acting hydraulic cylinder 24 secured to the web 22 and with the piston 25 (FIG. 2) of the actuator 23 extending through the web 22 on a radial line extending through the web 22 and transversely through the axis of the axle 15. The piston 25 is operably connected to a closure plate 26 (FIG. 2) in order to reciprocate the closure plate 26 toward and away from sealing closure with chambers 19 as they are registrably and successively located with their axis at that time on the projected axis of the piston 25. The fastening ring 27 provides a flange means for securing the actuator 23 to the web 22.

As will be seen, the closure plate 26 is perforated with communicating passages 28 (FIG. 2) which provide functional access to the interior of the chambers 19 when the closure plate 26 seals against the end 20 of the tubular cylinders 17. The closure plate 26 is valved and the valves 29 and 30 are mounted to the closure plate 26 between the legs 21. The valves 29 and 30 are shown as hydraulically actuated and the hydraulic cylinders 31 are indicated. Equivalent values of the pneumatic or solenoid operating type are available for the sequencing but electrical controls are not favored because of potential hazard at fueling. The valve 29 admits a combustible material such as methane and a combustion supporting material, such as oxygen, in near stoichiometric amounts for admixing relation and introduction to the chambers 19. The combustible material is admitted through the flex hose 32 and nipple 33 into the valve 29. The combustion supporting material is admitted to the valve 29 via the flex hose 34 and nipple 35. Since the mixture is highly explosive on admixture, the preferred mingling of the two materials is in the cover plate 26 using the communicating passages 28. The admission of the fuel air admixture pressurizes the chamber 19 to a selected positive pressure. The valve 30 is connected to a flexible vacuum line 36 connected to the valve 30 at nipple 37. The flexible hose 38 vents the chamber 19 and is similarly connected to the valve 30.

A spark plug 39 is in spark communication through the closure plate 26 to the interior of the chamber 19 via selected passages 28. An ignition wire 40 is shown connected to the spark plug 39 providing electrical means for initiation of the explosion in the chamber 19. The indexing drive 43 is operably connected to rotate the rotor block 14 on the axle 15.

Figure 2:
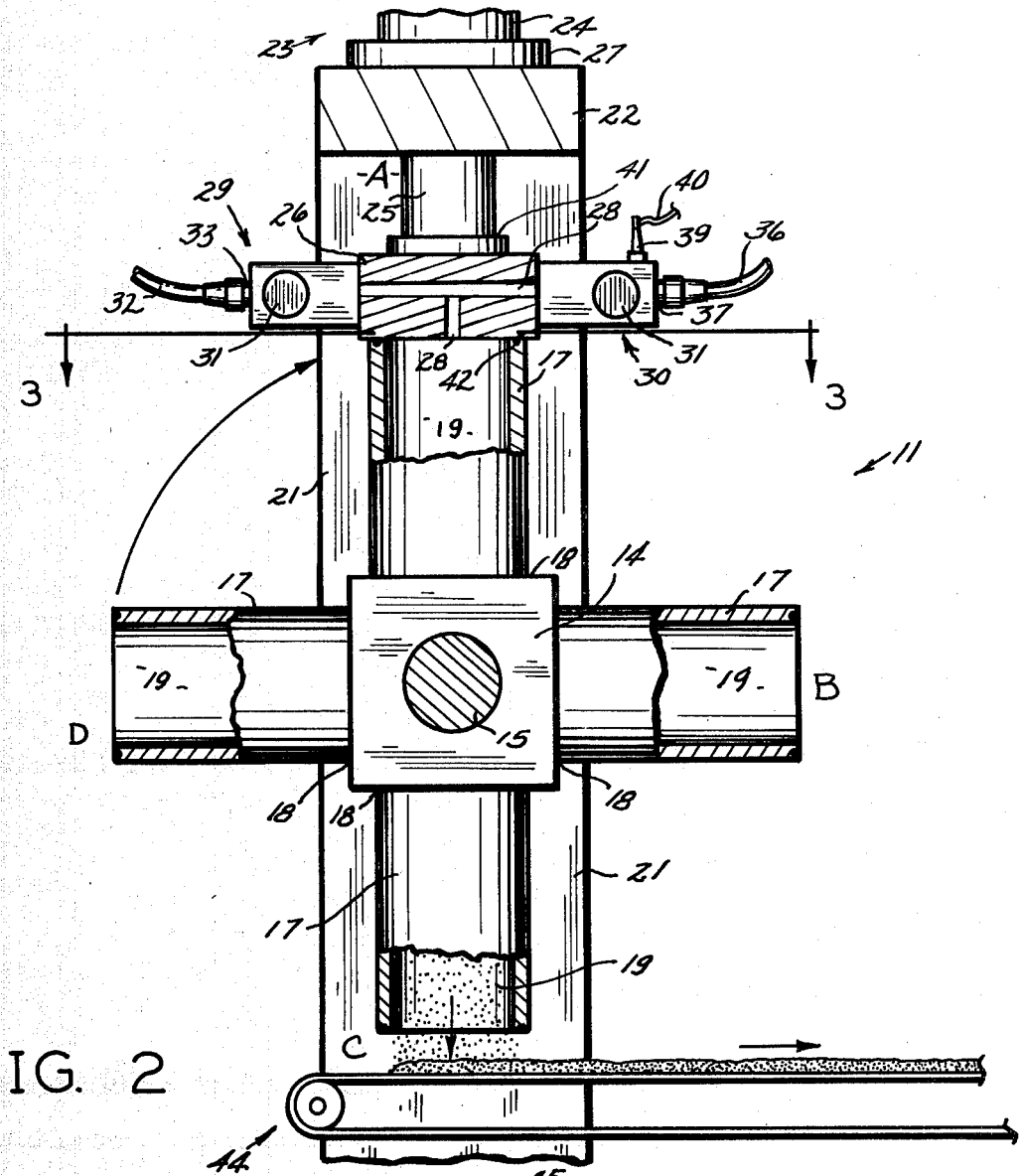
FIG. 2 is a full section elevation view taken on the line 2—2 of FIG. 1 and indicating the positioning of a conveyor between the legs of the frame and clearly indicating the journal simplicity for stress transfer at the horizontal axis.

In FIG. 2, some features and the function of the apparatus 11 are best understood. The piston 25 is connected as by connecting ring or flange 41 to the closure plate 26. When the chamber 19 (fully loaded with materials for treatment) is located as shown at the firing station A, the piston 25 is activated and moves the closure plate 26 into sealing contact against the annulus 20 of the tubular element 17. A gas tight seal is achieved at this interface and the type of seal is dependent upon the magnitude of forces encountered in the chamber 19 and is not a feature of the present invention. A seal 42 is schematically indicated. The sealing of the chamber 19 is followed by actuation of the valve 30 evacuating the gases from the chamber 19. Then, at the selected vacuum level, the valve 29 is actuated upon closure of the vacuum line 36 and combustion sustaining material and combustible material is admitted in metered quantities to the evacuated chamber 19. Then, with suitable pressurization, the valve 29 is closed and the spark plug 39 is activated igniting the cmbustible admixture. When this is done, the chamber 19 is subjected to the shock of the consequent explosion and the treated subject matter within the chamber 19 is effectively subjected to the shock waves of the explosion which permeate it throughout. If the treated subject matter includes castings having cores, the shock waves act on the binder (organic and/or inorganic) and in the ensuing fracturing the core is reduced to sand and combustion products without damage to the castings.

After the confined explosion, the vent function is energized via the valve 30 and the gaseous and vapor products of combustion are purged from the chamber 19 and the pressure in the chamber 19 is normalized to allow the retraction of the closure plate 26 by means of the linear actuator 24 and the thus opened chamber 19 is indexed to an unloading station B and a freshly loaded chamber 19 is positioned beneath the closure element 26 at the firing station A. After unloading, which involves removal of the treated items, such as the castings (for core shake-out), the chamber 19 is inverted at the dump station C. The sand falls onto a conveyor unit 44 and the sand is removed for discard or recycling for reuse. On the next move of the indexing drive 43, the chamber 19 is presented to loading station D where new material to be treated, such as castings with cores therein, is inserted. Then the loaded chamber 19 is indexed by rotation to the firing or ignition station A, as shown. The dwell at each station is paced by the timed interval required for closure of the chamber, evacuation, charging with fuel admixture, detonating or firing, purging, and then opening. On each index movement, a firing or initiation of a confined explosion occurs.

Figure 3:
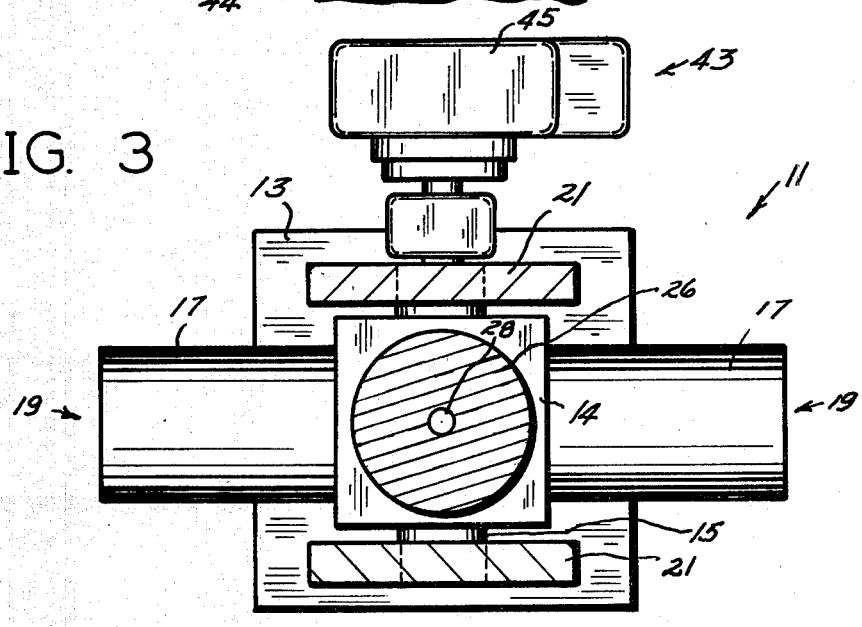
FIG. 3 is a partial top plan section view taken on the line 3—3 of FIG. 2 through the closure plate and indicating the plural communication passages for vacuum, fuel admixture, firing, and sweep or pressure release.
Figure 7:
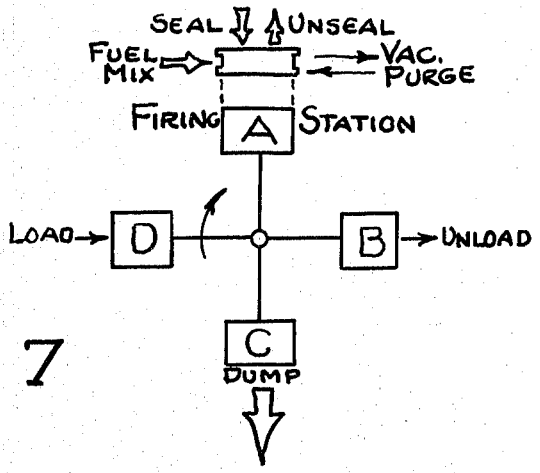
FIG. 7 is a diagramatic representation of the functional aspects of the present apparatus and schematized for clarity.

In FIG. 3, the drive motor 45 for the index drive 43 is shown outboard of the leg 21 and the drive 43 is shown operably connected to move the rotor block 14 in 90° step increments and the connected plural tubes 17 in successive manner as described. The simplicity of timing and of sequencing is based upon the dwell at station A. Upon completion of index movement of a chamber to A, the sealing is initiated and the steps achieved through the passages 28 are successively completed, including firing, purging and opening or unsealing. The opening of the closure plate 26 signals (as by a limit switch engaging closure plate 26) another indexing and the index cycle repeats with the dwell in the entire system pacing the production of the apparatus 11. The sequence diagram of FIG. 7 is helpful in following the operational steps and appreciating the simplicity of control over the apparatus 11.

As will be appreciated, a vacuum creating device is operably attached to the vacuum flex line 36. The two-part fuel mix enters also from separate tanks or reservoirs, not shown, and are connected to the valve 29 by the flexible connections, as indicated. This makes the apparatus extremely versatile and simple. Stressing of the entire apparatus is transmitted through the axle 15 and into the frame 12 via the journals in legs 21 and the web 22 resulting in a very economic and simple handling of the explosion stresses under confinement.

Figure 4:
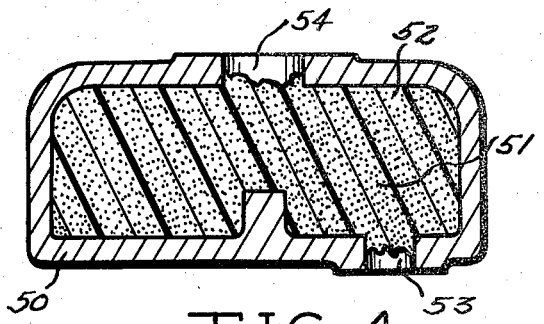
FIG. 4 is a full cross section elevation view through a typical casting in which a sand core remains intact and requiring removal but defying easy removal.
Figure 5:
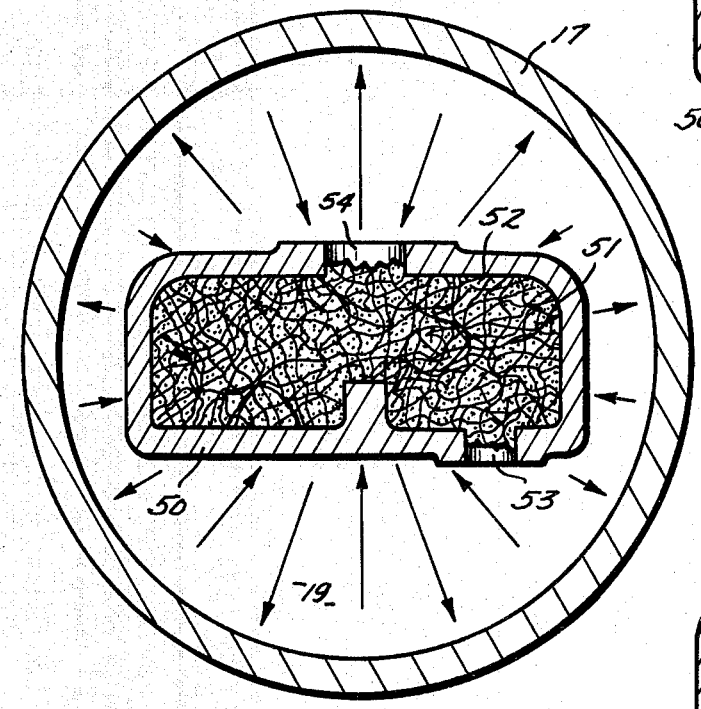
FIG. 5 is a full cross section elevation view through a chamber in accord with the present invention and with force arrows schematically indicating the moment of ignition or combustion and explosion with resultant confined shock and indicating consequent interstitial break-up of organic and/or inorganic bonds between sand particles.
Figure 6:
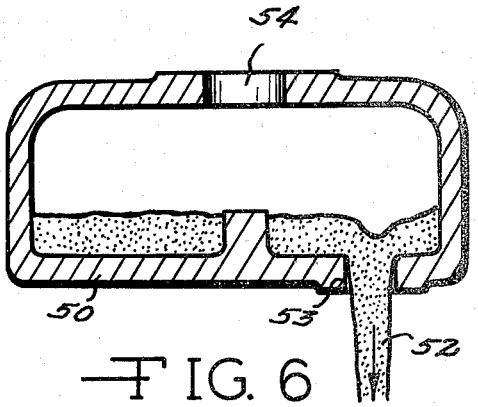
FIG. 6 shows the casting of FIG. 4 in which the binding in the core material has been shattered and the consequent particles, such as sand, are flowing from an opening in the casting at shake-out.

In FIG. 4, a casting 50 is shown in which the core 51 is sand 52 in an organic or inorganic binder matrix as indicated by the hachure symbol. In the casting process, the core was not consumed but must be removed cleanly from the casting 50 and most of the time physical access to the core 51 or portions of it are blocked by the intricacy of the casting or part. Such castings 50 typically produced from permanent moldings are placed in the chambers 19 and are successively moved to treatment subjecting the part or casting 50 and throughout its core 51 to confined shock sufficient to break or degrade the binder material and free the sand particles 52. At unloading, the sand 52 easily flows from openings such as 53 or 54 in the castings 50.

As applied to sand based cores, the apparatus and the process practiced by the apparatus is very effective in achieving decoring where manual efforts at decoring have resulted in damaged and rejected parts and severe time bottleneck resulting from the required extra man hours.

High strength metal such as steel is the preferred material for the chambers 19, the machine frame 12, the closure plate 26 and block 14. Additional strength as by forging or other integral forming such as casting with increased cross sectional dimensioning is available as needed and dictated by reasonable engineering practices. The selection of materials is regarded here as a matter of choice in accord with the intended use environment.

Having thus fully disclosed my invention and a preferred embodiment thereof, those skilled in the art will perceive changes, modifications and improvements and such changes, modifications and improvements are intended to be included herein limited only by the scope of my hereinafter appended claims.

I claim:

1. An apparatus for confined explosion decoring of castings comprising:

a machine frame having a pair of upstanding legs;

a web bridging said legs of said frames at a top location thereof so that said frame is in the form of an inverted U;

a rotor block rotatably mounted between said legs;

a plurality of chambers fixed to said rotor block and radially extending therefrom movable in a vertical plane with said block, said chambers rotating on an axis journalled in the legs of said frame and between the legs of said frame;

plural stations radially related to said rotor block including an ignition station at the web having a closure plate engageable with said chambers, and a linear actuator secured to said web and connected to said closure plate for closing said closure plate against a chamber facing the closure plate;

an unloading station;

a dumping station at a bottom location; and a loading station, said chambers being open at all of said stations except at said ignition station;

said closure plate and said linear actuator at said ignition station being situated on a radial line through the axis of successively and registrably located chambers and including plural communicating passages therethrough;

valve means selectively opening and closing flow into and out of said passages and into and out of said chambers as successively presented;

an igniter device connectable to said chambers when closed by the closure plate;

conduits to and from said valves for control of flow of combustion gas and oxygen, vacuum, and purge to said chambers as successively presented;

and an index drive driving said rotor block to successive stations;

said rotor block being journalled on a horizontal axis through said frame, so that said frame absorbs stresses at said journals as generated by closure of the chamber at the top location by the linear actuator and by explosion stresses in said chambers upon ignition of the combustion gas and oxygen.

* * * * *